US007865128B2

(12) United States Patent
Lee

(10) Patent No.: US 7,865,128 B2
(45) Date of Patent: Jan. 4, 2011

(54) DISCHARGING UNIT AND IMAGE FORMING APPARATUS HAVING THE SAME

(75) Inventor: Choong-yong Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 225 days.

(21) Appl. No.: 12/045,835

(22) Filed: Mar. 11, 2008

(65) Prior Publication Data

US 2008/0310900 A1 Dec. 18, 2008

(30) Foreign Application Priority Data

Jun. 12, 2007 (KR) ..... 10-2007-0057474

(51) Int. Cl.
*G03G 15/00* (2006.01)
*B65H 29/70* (2006.01)

(52) U.S. Cl. ..... 399/406; 271/188

(58) Field of Classification Search ..... 399/405, 399/406

See application file for complete search history.

(56) References Cited

U.S. PATENT DOCUMENTS 5,769,412 A * 6/1998 Takemoto et al. ..... 271/188
6,292,650 B1 * 9/2001 Akiyama ..... 399/401
7,173,717 B2 * 2/2007 Saito ..... 358/1.12
2006/0163803 A1 * 7/2006 Izuchi et al. ..... 271/272
2006/0181004 A1 * 8/2006 Kayama et al. ..... 271/188

FOREIGN PATENT DOCUMENTS

JP 05186085 A * 7/1993
JP 6-35241 5/1994
JP 2001226015 A * 8/2001
JP 2006-151669 6/2006
JP 2006151669 A * 6/2006

OTHER PUBLICATIONS

English lanugage abstract of JP 2006-151669, published Jun. 15, 2006.
English language abstract of JP 6-35241, published May 10, 1994.

* cited by examiner

*Primary Examiner*—Daniel J Colilla
*Assistant Examiner*—Allister Primo
(74) *Attorney, Agent, or Firm*—Stanzione & Kim LLP

(57) ABSTRACT

A discharging unit for discharging a printing medium from an image forming apparatus includes an elastic roller and a curl preventing roller to oppose each other in a pressing relationship forming a nip therebetween to reduce curling of a print medium passing through the nip. At least one of the elastic roller and the curl preventing roller is allowed to move towards or away from the other roller so that the nip can be adjusted to accommodate different thicknesses of varying types of printing medium.

14 Claims, 6 Drawing Sheets

DISCHARGING UNIT AND IMAGE FORMING APPARATUS HAVING THE SAME

CROSS-REFERENCE TO RELATED APPLICATIONS

This application claims priority from Korean Patent Application No. 10-2007-0057474, filed on Jun. 12, 2007 in the Korean Intellectual Property Office, the disclosure of which is incorporated herein by reference.

BACKGROUND OF INVENTION

1. Field of Invention

Apparatuses and methods consistent with the present invention relate to a discharging unit and an image forming apparatus having the same, and more particularly, to a discharging unit capable of reducing the curling, and enhancing the rectilinear property, of a printing medium, and to an image forming apparatus having the same.

2. Description of the Related Art

A discharging unit may discharge various printing media such as, e.g., a standard printing paper, wallpaper, transparencies, glossy photograph paper, or the like, from an image forming apparatus, which forms a visual recording such as a pattern, text, an image on the surface of the printing medium, and may thereby allow the recording medium to exit from the image forming apparatus once the visual recording has been formed thereon.

The image forming apparatus forms the image on the printing medium with developer, e.g., ink, ink ribbon, toner, or the like, and applies heat and/or pressure to the printing medium during the process. During this process, the printing medium may become thermally deformed in the direction of the heat being applied, and may become curled as a result. The printing medium when so curled may interfere, and/or be interfered with, printing medium previously discharged, and may push the already discharged printing medium out of alignment from a neat stack, and may even become jammed within the discharging unit.

Accordingly, it may be desirable to minimize the curling of the printing medium as the same exits from an image forming apparatus.

Japanese Laid Open Patent Application No. 2006-151669 discloses a discharging device including a crossing roller and an elastic roller purportedly to reduce the curling of the printing medium and to enhance the alignment of the discharged printing medium. Although the rectilinear property could be enhanced by the crossing roller disclosed, however, unfortunately, the disclosed structure, since the pair of elastic rollers reciprocally rotate with a predetermined nip, cannot accommodate different thicknesses of the various types of printing medium.

SUMMARY OF THE INVENTION

Accordingly, it is an aspect of the present invention to provide a discharging unit capable of accommodating the different thicknesses of the printing medium, and capable of reducing the curling of the printing medium, and an image forming apparatus having the same.

Additional aspects of the present invention will be set forth in part in the description which follows and, in part, will be obvious from the description, or may be learned by practice of the present invention.

The foregoing and/or other aspects can be achieved by providing a discharging unit for discharging printing medium from an image forming apparatus that includes at least one elastic roller configured to rotate about a first shaft; and at least one curl preventing roller configured to rotate in an opposing relationship with respect to the at least one elastic roller, the curl preventing roller being configured to form a nip with the at least elastic roller for passing a printing medium therethrough, at least one of the at least one elastic roller and the at least one curl preventing roller being configured to move in a direction such that the size of the nip can be adjusted to accommodate different printing medium of varying thickness to pass through the nip.

According to an aspect of the present disclosure, the discharging unit may further comprise a supporting member configured to rotatably support the at least one curl preventing roller; and an elastic member configured to apply a bias against the supporting member towards the elastic roller.

According to another aspect, the discharging unit may further comprise at least one pair of crossing rollers, a first one of the at least one pair of cross rollers being mounted to, and configured to rotate about the first shaft, a second one of the at least one pair of cross rollers being mounted to, and configured to rotate about a second shaft; wherein the supporting member is movably coupled to the second shaft.

According to yet another aspect, the supporting member may comprise a guide long hole formed thereon, the guide long hole having an opening that is larger than a diameter of the second shaft so that the second shaft is allowed to move toward and away from the elastic roller; and a center supporting opening configured to support a rotational center of the at least one curl preventing roller.

According to even yet another aspect, the at least one curl preventing roller is provided at a first location further towards an end portion of the second shaft than a second location where the at least one pair of crossing rollers are disposed.

According to further another aspect, the discharging unit may further include a power transmission unit, the power transmission unit comprising one or more driving gears provided at an end portion of one of the first shaft and the second shaft, the one or more driving gears receiving a driving force from a driving source; and one or more driven gears provided in the other one of the first shaft and the second shaft, the one or more driven gears configured to receive the driving force from the one or more driving gears.

According to even further another aspect, the discharging unit may further include a power transmission unit including a belt-pulley, which transmits a driving force from one of the first shaft and second shaft to the other one of the first shaft and second shaft.

According to yet even further another aspect, the supporting member further comprises a printing medium contact surface having a curvature, the curvature being in a curvature direction opposite to a curling direction, in which the printing medium was curled prior to the printing medium reaching the discharging unit.

According to another aspect, an image forming apparatus includes one or more of the above various aspects of a discharge unit.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF SEVERAL EMBODIMENTS

Figure 1:
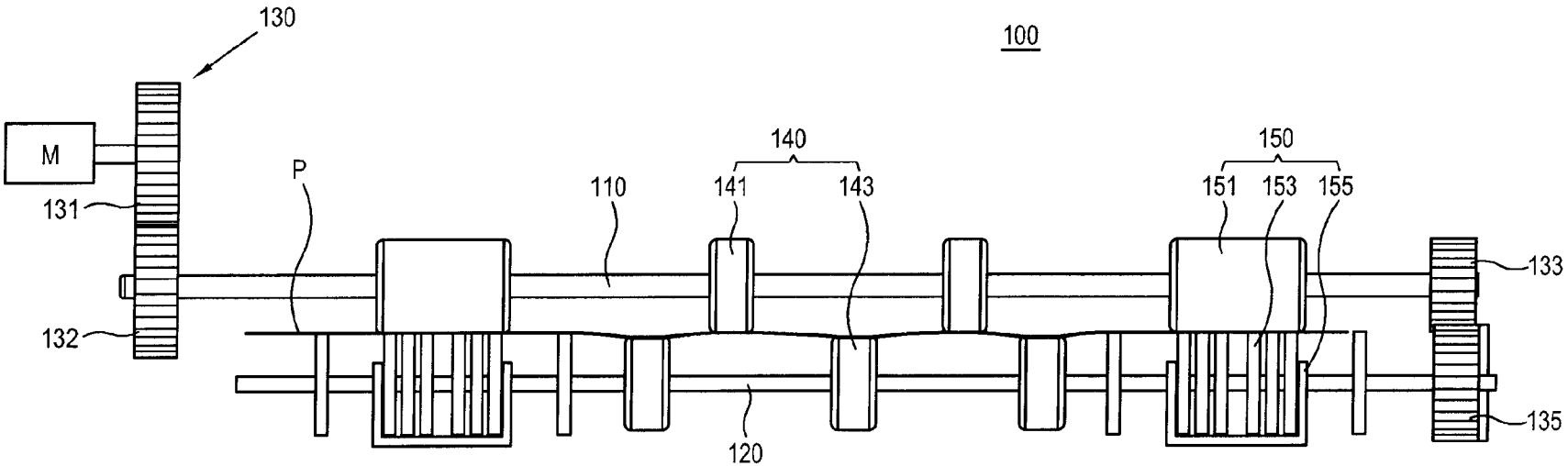
FIG. 1 is a front view schematically illustrating a configuration of a discharging unit according to an exemplary embodiment of the present invention.

Reference will now be made in detail to the embodiments of the present invention, examples of which are illustrated in the accompanying drawings, wherein like reference numerals refer to like elements throughout.

Figure 2:
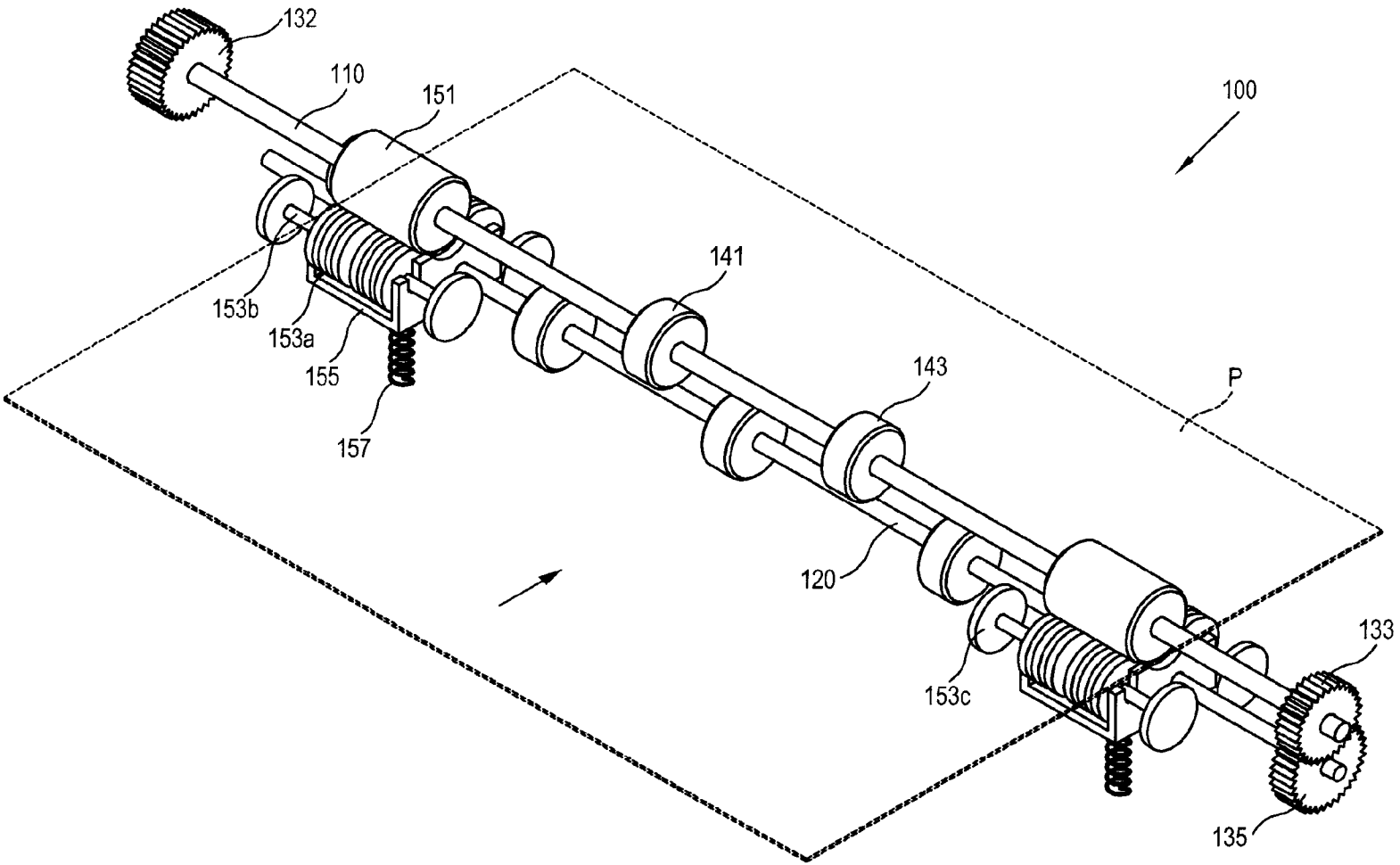
FIG. 2 is a perspective view illustrating a configuration of the discharging unit in FIG. 1.

FIG. 1 and FIG. 2 are a front view and a perspective view illustrating a configuration of a discharging unit according to an exemplary embodiment of the present invention. As shown in FIGS. 1 and 2, the discharging unit 100 according to the present invention includes a first rotational shaft 110 and a second rotational shaft 120 which are provided to be parallel with each other, a power transmission unit 130 which transmits power to the first rotational shaft 110 and the second rotational shaft 120, a crossing roller unit 140 for enhancing the rectilinear property of a printing medium P, and a curl preventing roller unit 150 which is provided to elastically move to adjust to the thickness of the printing medium P to reduce the curling of the printing medium.

The first rotational shaft 110 and the second rotational shaft 120 are disposed to be parallel with each other. The first rotational shaft 110 is provided with the rotational power from a driving unit M by the power transmission unit 130, and is thus made to rotate. The second rotational shaft 120 can be made to rotate in engagement with the first rotational shaft 110 as shown.

The power transmission unit 130 transmits a driving force generated from the driving unit M to the first rotational shaft 110 and second rotational shaft 120. The power transmission unit 130 transmits the driving force from the driving unit M to the first rotational shaft 110 and second rotational shaft 120 through a plurality of gears 131, 132, 133, and 135. The gear ratio of each of the gears 131, 132, 133, and 135 may be determined according to the respective desired rotational speed of the first rotational shaft 110 and second rotational shaft 120. The plurality of gears 131, 132, 133, and 134 may be disposed respectively in a predetermined location, e.g., at the ends of each rotational shaft, as shown.

The crossing roller unit 140 may include one or more first crossing rollers 141, which are coupled to the first rotational shaft 110, and one or more second crossing rollers 143, which are coupled to the second rotational shaft 120. The crossing rollers 141 and 143 are provided in an alternating manner to face each other diagonally, respectively on the first rotational shaft 110 and the second rotational shaft 120, to enhance the rectilinear property of the printing medium P.

The first crossing roller 141 rotates according to the rotation of the first rotational shaft 110, and the second crossing roller 143 rotates according to the rotation of the second rotational shaft 120. The first crossing roller 141 and the second crossing roller 143 may be disposed in the crossing fashion at the same interval or at different intervals to increase the contact area with the printing medium P as shown in FIGS. 1 and 2. The pressure, preferably, is applied to cover the entire area of the printing medium P to increase the distance the printing medium P is able to travel after having passed through the crossing roller unit 140.

The number and the width of the first crossing roller 141 and the second crossing roller 143 may be determined to correspond to the width and the length of the printing medium being used.

The curl preventing roller unit 150 forms a curl in the opposite direction to the curl that may have been formed on the printing medium P prior to its arrival at the discharging unit to reduce the curl on the printing medium as it leaves the discharging unit. The curl preventing roller unit 150 includes an elastic roller 151 which is coaxially coupled to the first rotational shaft 110, a curl preventing roller 153 which is non-axially coupled to the second rotational shaft 120, a supporting member 155, which rotatably supports the curl preventing roller 153, and an elastic member 157 which elastically biases the supporting member 155 toward the elastic roller 151.

The elastic roller 151 may be an elastic member such as, e.g., made of rubber material or the like. The elastic roller 151 rotates about, and with, the first rotational shaft 110, and applies a frictional force to the curl preventing roller 153 to rotate the curl preventing roller 153.

Figure 3:
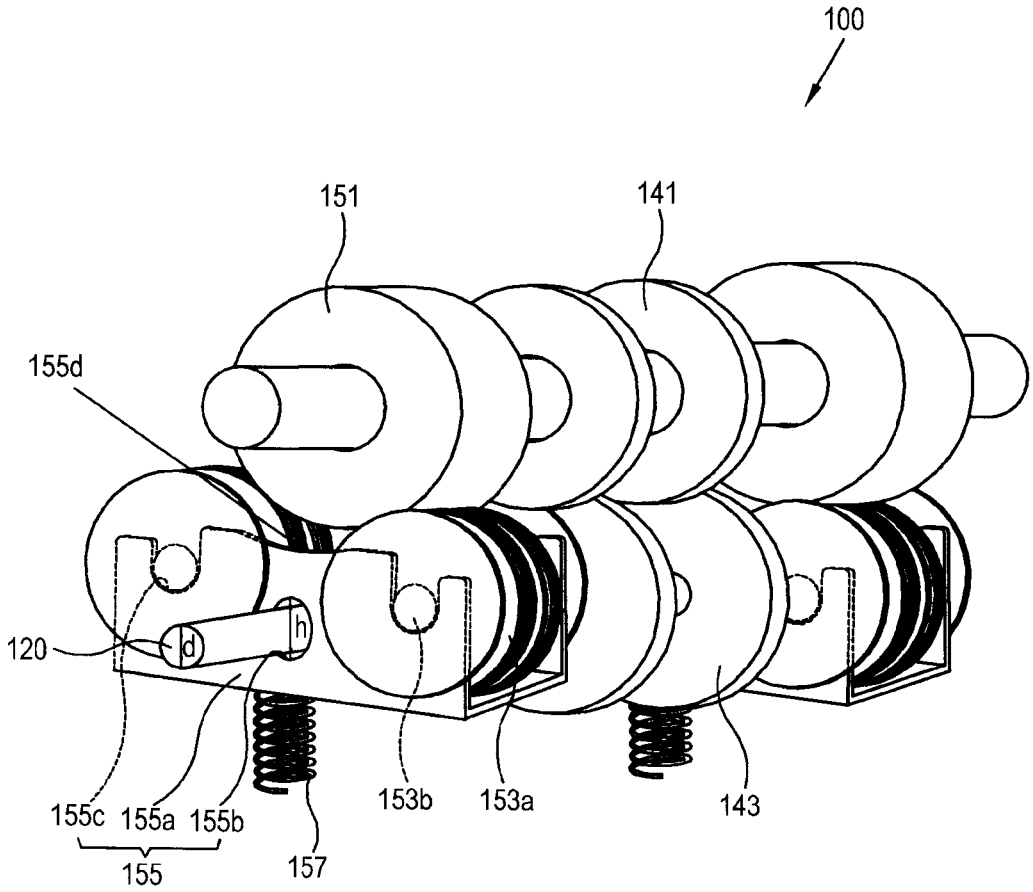
FIG. 3 is a right side perspective view illustrating a configuration of the discharging unit in FIG. 1.

As shown in FIGS. 2 and 3, the curl preventing roller 153 is provided on a different rotational shaft from the second rotational shaft 120. The curl preventing roller 153 includes a roller main body 153*a*, a rotating center 153*b*, which is rotatably supported on the supporting member 155, and a separation preventing plate 153*c* which prevents the separation of the supporting member 155 from the rotational center 153*b*.

The roller main body 153*a* may be constructed from sufficiently rigid material such as, e.g., plastic material or the like. The roller main body 153*a* rotates in contact with the elastic roller 151. The roller main body 153*a* is in a pressing contact with the elastic roller 151 to form a nip with the elastic roller 151. The printing medium P passes through the nip, and receives pressure from the elastic roller 151 and the curl preventing roller 153, thereby reducing the curl formed on the printing medium P.

The rotational center 153*b* is coupled to the supporting member 155 so that the roller main body 153*a* can rotate. The separation preventing plate 153*c* is provided to have a larger diameter than a center supporting opening 155*c* to prevent the rotational center 153*b* from being separated from the center supporting opening 155*c*.

Figure 4:
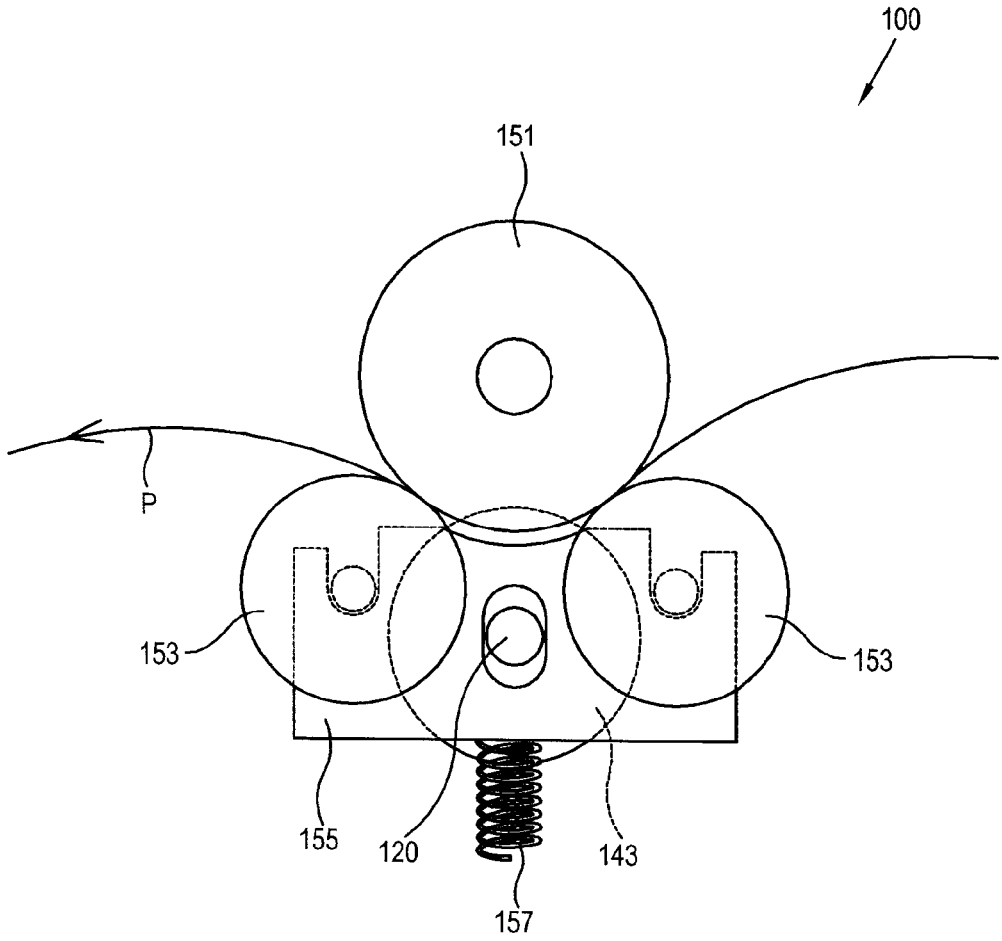
FIG. 4 is a sectional view illustrating a configuration of the discharging unit in FIG. 1.

Here, the curl preventing roller 153 may be provided as a pair of rollers so as to enhance the curl preventing effect. The pair of curl preventing rollers 153 are disposed to contact with the elastic roller 151, and are rotated by the rotation of the elastic roller 151 as shown in FIG. 4.

The supporting member 155 rotatably supports the curl preventing roller 153. The supporting member 155 includes a supporting member main body 155*a*, a guide long hole 155*b* provided in the supporting member main body 155*a* to accommodate and support the second rotational shaft 120, and the center supporting opening 155*c* which supports the rotational center 153*b* of the curl preventing roller 153. The center supporting opening 155*c* is provided in a U-shape to accommodate the roller main body 153*a*. As shown in FIG. 3, the guide long hole 155*b* is provided to have diameter h larger than diameter d of the second rotational shaft 120 to allow a change in the height of the curl preventing roller 153, in conjunction with the upward bias supplied by the elastic member 157. Accordingly, the size of the gap in the nip between the curl preventing roller 153 and the elastic roller 151 can be varied.

The center supporting opening 155*c* is provided to have a size corresponding to the diameter of the rotational center 153*b* to rotatably support the rotational center 153*b*.

The upper surface 155*d* of the supporting member 155 is provided to have a curvature. The curvature may be provided in a direction to negate or oppose the direction of curvature that may have been formed during when the printing medium P passes through a fusing unit (e.g., the fusing unit 235 shown in FIG. 5).

The elastic member 157 elastically supports the supporting member 155. The elastic member 157 may be provided between the frame of the image forming apparatus (not shown) and the supporting member 155, and is elastically deformed according to the thickness of the printing medium P having entered between the elastic roller 151 and the curl preventing roller 153 to regulate the height of the supporting member 155. Accordingly, the nip between the curl preventing roller 153 and the elastic roller 151 can be adjusted to allow different thicknesses of various types of printing medium P to pass through the two rollers.

In the example, the curl preventing roller unit 150 is shown as being provided in opposite ends of the second rotational shaft 120, but the positions of the curl preventing roller unit 150 may be provided in other locations or can even be adjusted by changing the location of coupling of the supporting member 155 with the second rotational shaft 120.

Figure 5:
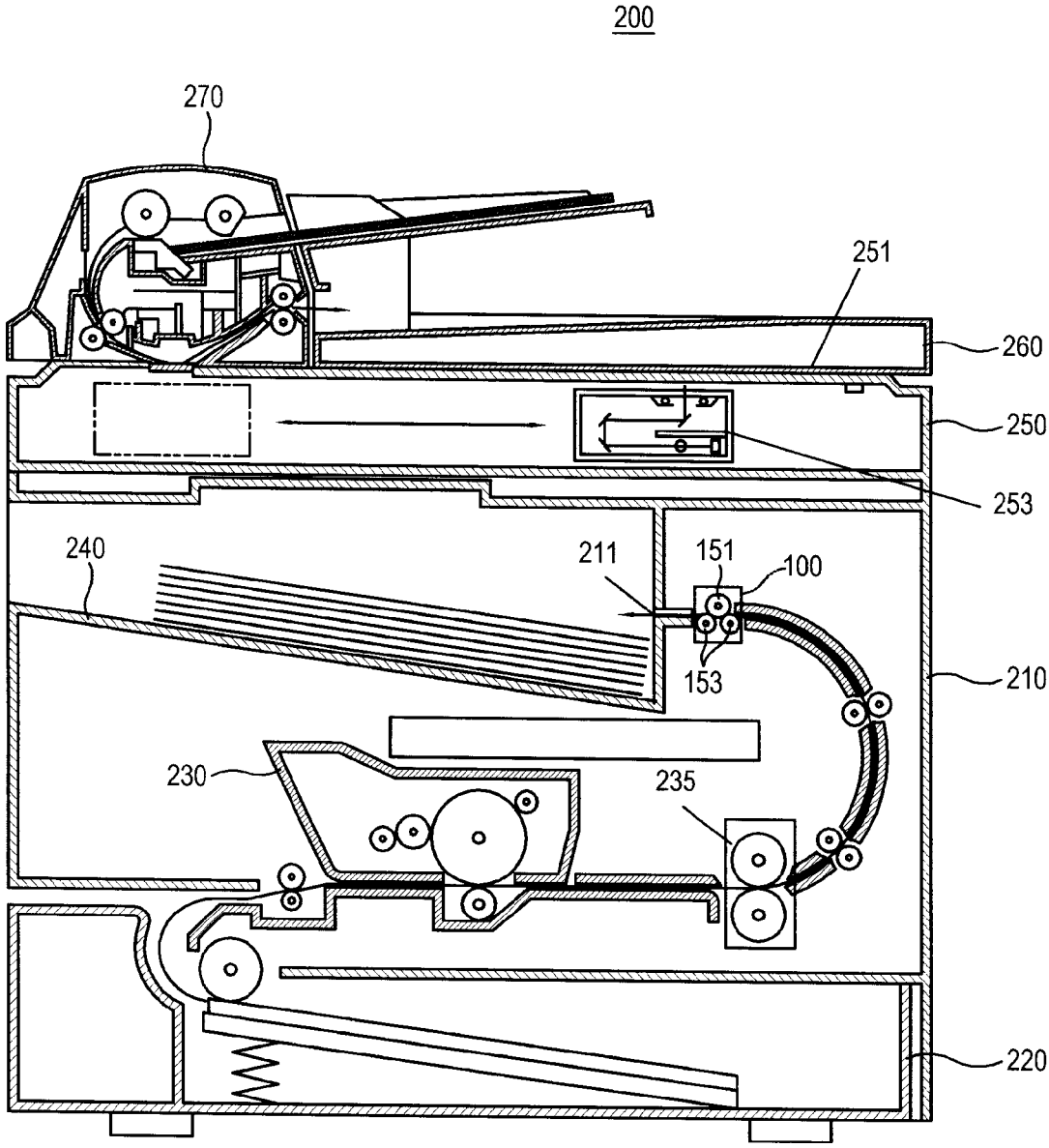
FIG. 5 is a schematic view illustrating a configuration of an image forming apparatus according to the present invention.

FIG. 5 is a schematic view illustrating a configuration of an image forming apparatus 200 having the discharging unit 100 according to the present invention.

As shown in FIG. 5, the image forming apparatus 200 according to the present invention may include a casing 210, a feeding unit 220 which feeds a stored printing medium to an image forming unit 230, the image forming unit 230 which forms an image on the printing medium, and a discharging unit 100 which discharges the printing medium on which the image is formed to the outside. The image forming apparatus 200 may also include a scanning unit 250 that reads an original document to generate an image data therefrom, a flat bed cover 260 provided in the upper side of the casing 210 to open and close to reveal and cover a stage glass 251, on which the original document to be scanned may be placed.

The casing 210 accommodates and supports the feeding unit 220, the image forming unit 230 and the discharging unit 100. The casing 210 includes an outlet 211 which discharges the printing medium on which the image is formed in the image forming unit 230 to the outside. The outlet 211 is provided on one side of the crossing roller 140 and the curl preventing roller unit 150 to discharge the image-formed printing medium to the loading plate 240.

The flat bed cover 260 closes to cover the stage glass 251 provided on the upper side of the casing 210. The flat bed cover 260 when open allows the loading of an original document on the stage glass 251, and may be kept closed during the scanning of the original document by an image sensor 253. The flat bed cover 260 may further include an automatic feeding unit 270 which automatically feeds the original document to the scanning unit 260.

The feeding unit 220 is detachably provided on one side of the casing 210 to feed the printing medium to the image forming unit 230. More than one feeding unit 220 may be provided.

The image forming unit 230 forms an image on the printing medium fed from the feeding unit 220. The image forming unit 230 can visualize on the printing medium an image data received from a host apparatus (not shown), and/or the image data generated by the scanning unit 250 from scanning of an original document.

The image forming unit 230 can employ an electrophotography type in which developer is used, an ink jet type in which ink is used, and a thermal transfer type in which an ink ribbon is used according to the particular method of forming the image employed. The image forming unit 230 according to an exemplary embodiment of the present invention employs the electrophotography type in which developer is spread on the printing medium through a potential difference to form an image.

Hereinafter, the image forming method of the image forming apparatus 200 will be described by referring to FIGS. 1 through 5.

When a printing signal is received, the feeding unit 220 feeds a printing medium. The image forming unit 230 applies the developer on the printing medium P to form a developer image. The printing medium P is applied with heat and pressure while passing through a fusing unit 235 so that the developer image is fixed on the printing medium P. As a result of the application of heat, a curl may be formed on the printing medium in a direction based on the direction of the application of the heat from the fusing unit 235.

When the printing medium with the curl reaches the discharging unit 100, it enters between the crossing roller 140 and the curl preventing roller unit 150. If the printing medium P enters between the elastic roller 151 and the curl preventing roller 153, the elastic member 157 is allowed to be elastically compressed or expanded according to the thickness of the printing medium P and the guide long hole 155*b* is allowed to move upward and downward along with the second rotational shaft 120 also according to the thickness of the printing medium P. Accordingly, printing media of varying thickness can be accommodated through the nip between the elastic roller 151 and the curl preventing roller 153.

In addition, as shown in FIG. 4, when the printing medium P enters between the elastic roller 151 and a first curl preventing roller 153, the printing medium P is pressed while passing through the nip, and is guided along the curvature formed on the upper surface 155*d* in an opposite direction to the direction of the existing curl of the printing medium. The printing medium P having entered a second curl preventing roller 153 is pressed again by the elastic roller 151 and the second curl preventing roller 153, and is subsequently discharged to the outside. As a result, the printing medium P as it exits the discharging unit 100 exhibit less curl than when the same before entering the discharging unit 100.

Also, the printing medium P is contacted with the crossing roller unit 140 to increase its contact area, and can maintain the rectilinear property as shown in FIG. 2. Accordingly, the printing medium can be prevented from being misaligned due to the leading edge of the printing medium currently being discharged making a contact with or being interfered with the printing medium already discharged and are present on the loading plate 240.

In the image forming apparatus 200 according to an exemplary embodiment of the present invention, a multi-functional device has been described as one example, but other type image forming apparatuses may be applied.

Figure 6:
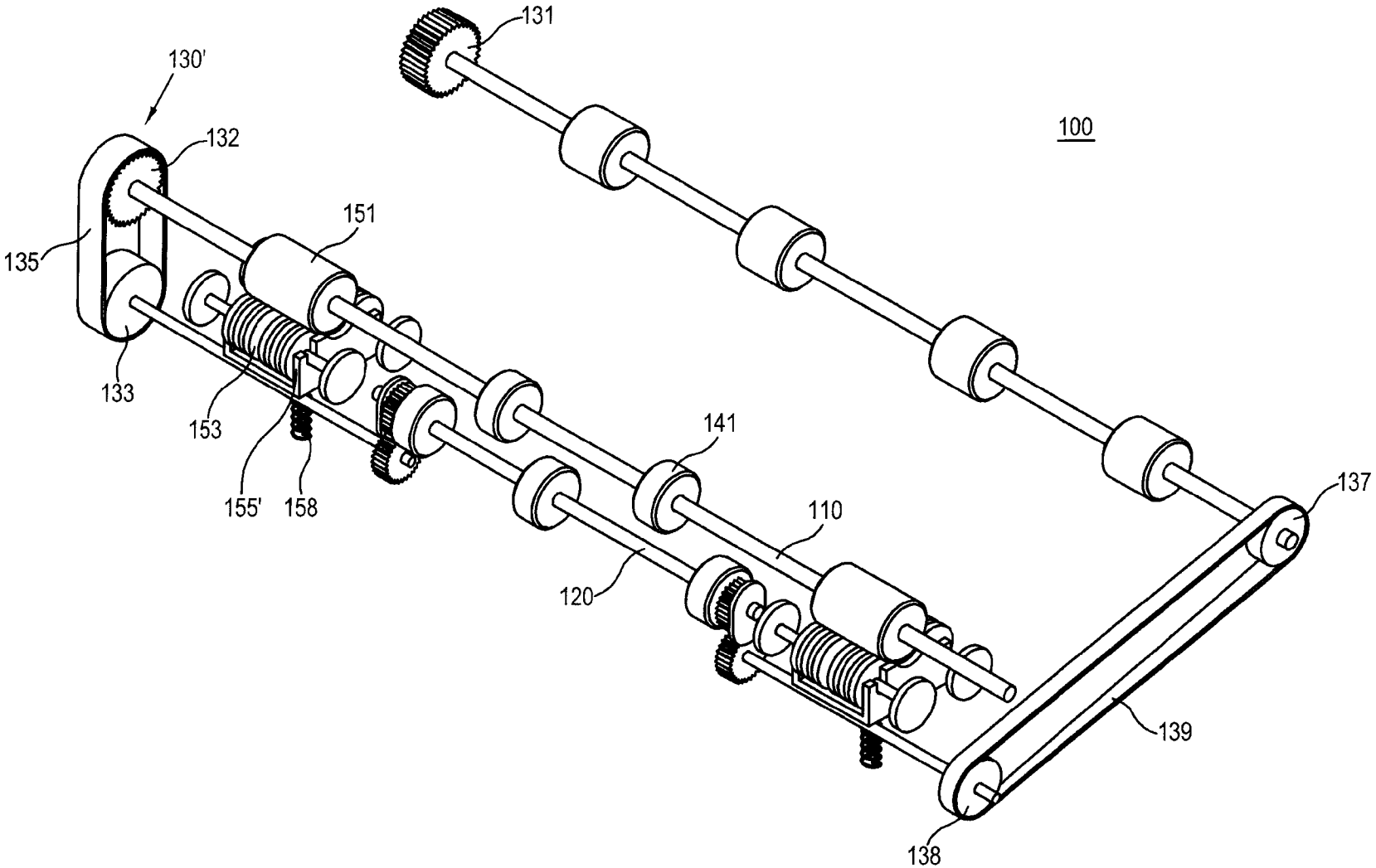
FIG. 6 is a perspective view illustrating a configuration of a discharging unit according to another exemplary embodiment of the present invention.

FIG. 6 is a schematic view illustrating a configuration of a discharging unit 100' according to another embodiment. In the discharging unit 100' according to this example, a power transmission unit 130' is provided as a belt-pulley. Accordingly, a supporting member 155' is not coupled to the second rotational shaft 120 but it may be supported by an elastic member 158.

In addition, in the discharging unit 100' according to the present example, the configuration of the power transmission unit 130' may be variously changed to allow various positions and number of the curl preventing roller 153.

As described above, the nip between the curl preventing roller and the elastic roller in the discharging unit of an image forming apparatus is allowed to be adjusted to accommodate variance in the thickness of the printing medium to reduce curling of the printing medium, to better preserve rectilinear property of the printing medium and/or to preventing the printing medium from becoming jammed in the discharging unit.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A discharging unit for discharging printing medium from an image forming apparatus, comprising:

a plurality of elastic rollers coupled to a first shaft rotatably driven by a driving source, the plurality of elastic rollers arranged to be spaced apart from one another;

a crossing roller unit comprising one or more first crossing rollers coupled to the first shaft between elastic rollers and one or more second crossing rollers arranged to respectively cross the one or more first crossing rollers, the one or more second crossing rollers each being coupled to a second shaft engaged to interlock with the first shaft; and a plurality of curl preventing roller units respectively corresponding to the plurality of elastic rollers, each of the plurality of curl preventing roller units comprising a first curl preventing roller and a second curl preventing roller arranged along transfer path of the printing medium to form a nip with respective corresponding one of the plurality of elastic rollers for passing the printing medium therethrough, the first and second curl preventing rollers being supported by shafts having their respective rotational centers different from those of the first shaft and second shaft, wherein at least one of the plurality of curl preventing roller units is configured to move in a direction such that the size of the nip can be adjusted to accommodate different printing medium of varying thickness to pass through the nip.

2. The discharging unit according to claim 1, further comprising:

a supporting member configured to rotatably support the first curl preventing roller and the second curl preventing roller; and an elastic member configured to apply a bias against the supporting member towards the first shaft.

3. The discharging unit according to claim 2, wherein the supporting member comprises:

a guide long hole formed thereon, the guide long hole having an opening that is larger than a diameter of the second shaft so as to allow the supporting member to move relative to the second shaft along a direction toward and away from the first shaft; and center supporting openings configured to support respectively rotational shafts of the first curl preventing roller and the second curl preventing roller.

4. The discharging unit according to claim 1, wherein each of the plurality of curl preventing roller units is provided at respective first location further towards an end portion of the second shaft than a second location where the crossing roller unit is disposed.

5. The discharging unit according to claim 2, further comprising:

a power transmission unit, the power transmission unit comprising one or more driving gears provided at an end portion of one of the first shaft and the second shaft, the one or more driving gears receiving a driving force from the driving source; and one or more driven gears provided in the other one of the first shaft and the second shaft, the one or more driven gears configured to receive the driving force from the one or more driving gears.

6. The discharging unit according to claim 1, further comprising:

a power transmission unit including a belt-pulley, which transmits a driving force from one of the first and second shafts to the other one of the first and second shafts.

7. The discharging unit according to claim 2, wherein the supporting member further comprises:

a printing medium contact surface having a curvature, the curvature being in a curvature direction opposite to a curling direction, in which the printing medium was curled prior to the printing medium reaching the discharging unit.

8. An image forming apparatus, comprising:

a feeding unit configured to feed a printing medium;

an image forming unit which forms an image on the printing medium fed from the feeding unit; and a discharging unit configured to discharge the printing medium, on which the image is formed, from the image forming apparatus, the discharging unit comprises, a plurality of elastic rollers coupled to a first shaft rotatably driven by a driving source, the plurality of elastic rollers arranged to be spaced apart from one another;

a crossing roller unit comprising one or more first crossing rollers coupled to the first shaft between elastic rollers and one or more second crossing rollers arranged to respectively cross the one or more first crossing rollers, the one or more second crossing rollers each being coupled to a second shaft engaged to interlock with the first shaft; and a plurality of curl preventing roller units respectively corresponding to the plurality of elastic rollers, each of the plurality of curl preventing roller units comprising a first curl preventing roller and a second curl preventing roller arranged along transfer path of the printing medium to form a nip with respective corresponding one of the plurality of elastic rollers for passing the printing medium therethrough, the first and second curl preventing rollers being supported by shafts having their respective rotational centers different from those of the first shaft and second shaft, wherein at least one of the plurality of curl preventing roller units is configured to move in a direction such that the size of the nip can be adjusted to accommodate different printing medium of varying thickness to pass through the nip.

9. The image forming apparatus according to claim 8, wherein the discharging unit further comprises:

a supporting member configured to rotatably support the first curl preventing roller and the second curl preventing roller; and an elastic member configured to apply a bias against the supporting member towards the first shaft.

10. The image forming apparatus according to claim 9, wherein the supporting member comprises:

a guide long hole formed thereon, the guide long hole having an opening that is larger than a diameter of the second shaft so as to allow the supporting member to move relative to the second shaft along a direction toward and away from the first shaft; and center supporting openings configured to support respectively rotational shafts center of the at lest one first curl preventing roller and the second curl preventing roller.

11. The image forming apparatus according to claim 8, wherein each of the plurality of curl preventing roller units is provided at respective first location further towards an end portion of the second shaft than a second location where the crossing roller unit is disposed.

12. The image forming apparatus according to claim 8, wherein the discharging unit further comprises:

a power transmission unit, the power transmission unit comprising one or more driving gears provided at an end portion of one of the first shaft and the second shaft, the one or more driving gears receiving a driving force from the driving source; and one or more driven gears provided in the other one of the first shaft and the second shaft, the one or more driven gears configured to receive the driving force from the one or more driving gears.

13. The image forming apparatus according to claim 8, wherein the discharging unit further comprises:

a power transmission unit including a belt-pulley, which transmits a driving force from one of the first and second shafts to the other one of the first and second shafts.

14. The image forming apparatus according to claim 9, wherein the supporting member further comprises:

a printing medium contact surface having a curvature, the curvature being in a curvature direction opposite to a curling direction, in which the printing medium was curled prior to the printing medium reaching the discharging unit.

* * * * *